US005941391A

United States Patent [19]

Jury

[11] Patent Number: 5,941,391

[45] Date of Patent: Aug. 24, 1999

[54] VACUUM STORAGE SYSTEM

[76] Inventor: Dan E. Jury, 313 N. Colorado, Ulysses, Kans. 67880

[21] Appl. No.: 08/922,765

[22] Filed: Sep. 3, 1997

[51] Int. Cl.[6] ..... B65D 81/20

[52] U.S. Cl. ..... 206/524.8; 206/315.9; 137/223; 137/493.9; 137/493.1

[58] Field of Search ..... 206/315.9, 524.8; 137/493.1, 493.9, 223; 220/231, 212

[56] References Cited

U.S. PATENT DOCUMENTS

| | | | |
|---|---|---|---|
| 3,159,176 | 12/1964 | Russell et al. | 137/493.9 |
| 3,945,392 | 3/1976 | Deaton et al. . | |
| 4,013,076 | 3/1977 | Puderbaugh et al. . | |
| 4,428,478 | 1/1984 | Hoffman | 206/315.9 |
| 4,494,363 | 1/1985 | Rica et al. . | |
| 4,584,182 | 4/1986 | Sanderson et al. . | |
| 4,941,310 | 7/1990 | Kristen . | |
| 5,111,938 | 5/1992 | Soprano et al. . | |
| 5,326,237 | 7/1994 | Cecil et al. . | |
| 5,405,038 | 4/1995 | Chuang | 220/231 |
| 5,455,180 | 10/1995 | Reid . | |
| 5,465,857 | 11/1995 | Yang | 206/524.8 |
| 5,651,470 | 7/1997 | Wu | 206/524.8 |

*Primary Examiner*—David T. Fidel
*Attorney, Agent, or Firm*—Chase & Yakimo, L.C.

[57] ABSTRACT

A vacuum storage system for extending the life of the goods stored therein. The system includes a chamber having an open end, a lid releasably securable to the chamber over its open end and a vacuum adapted for positioning on the lid to evacuate air from within the chamber. The lid has a neck portion with an aperture therethrough and includes a stopper sealably mounted within the aperture and a plug mounted within the stopper for regulating the evacuation of the air within the chamber. The stopper has a channel formed therethrough. The plug has a flared exterior end, an elongated portion and a flared interior end. The elongated portion extends through the channel and has a diameter smaller than the channel's diameter for free movement therein. This allows the vacuum to evacuate air from within the chamber through the channel. The plug's flared exterior end is forced to engage the stopper and seal the channel upon evacuation of the air. The flared interior end engages the stopper and seals the channel to prevent the over evacuation and collapse of the chamber.

5 Claims, 6 Drawing Sheets

VACUUM STORAGE SYSTEM

FIELD OF THE INVENTION

This invention relates to a storage system for a variety of goods, such as food products and paint products. More specifically, a container adapted for easy vacuum packed storage of liquid and/or dry goods is provided.

BACKGROUND OF THE INVENTION

Unless vacuum packed, food products, whether liquid or dry, spoil fairly quickly and can emit horrible odors. Similarly, paint products can dry out and also emit dangerous fumes. Lids and storage devices have been developed for use with food and paint storage containers that seal outside air from the goods stored within the container.

However, a simple, easy-to-use system for household or commercial use that allows goods to be vacuum packed would be advantageous. Vacuum packing has the added benefit of evacuating the air from within the container as well as sealing off the outside air. This increases storage life and eliminates odors and fumes.

SUMMARY OF THE INVENTION

Accordingly, a primary object of the subject invention is to provide a food storage system that includes a container that is easily vacuum sealed to improve the storage life of the goods stored therein and prevent odors from emanating therefrom.

Another object of the subject invention is to provide a food storage system having a lid with a stopper and plug combination that allows the volume of air or gas to be evacuated from within the container at a specific rate.

Still another object of the subject invention is to provide a vacuum storage system adapted for easy vacuum storage of household items, such as food and paint products.

These objects are attained by providing a vacuum storage system, comprising a chamber having an open end, a lid releasably securable to the chamber over its open end and a vacuum adapted for positioning on the lid to evacuate air from within the chamber. The lid has a neck portion with an aperture therethrough and includes a stopper sealably mounted within the aperture and a plug or valve device mounted within the stopper. The stopper has a channel formed therethrough. The channel includes a tapered portion formed at the exterior and interior ends thereof. The plug has an exterior flange, an elongated portion and an interior flange. The elongated portion extends through the channel and has diameter smaller than the channel's diameter for free movement therein. This allows the vacuum to evacuate air from within the chamber through the channel. The plug's exterior flange engages and mates with the stopper's exterior tapered portion to seal the chamber upon evacuation of the air. The plug's interior flange engages the stopper's interior tapered portion to prevent the container from collapsing or the air therein being evacuated too quickly.

Other objects and advantages of this invention will become apparent from the following description taken in connection with the accompanying drawings, wherein is set forth by way of illustration and example, an embodiment of this invention.

DETAILED DESCRIPTION OF THE PREFERRED EMBODIMENT

Figure 1:
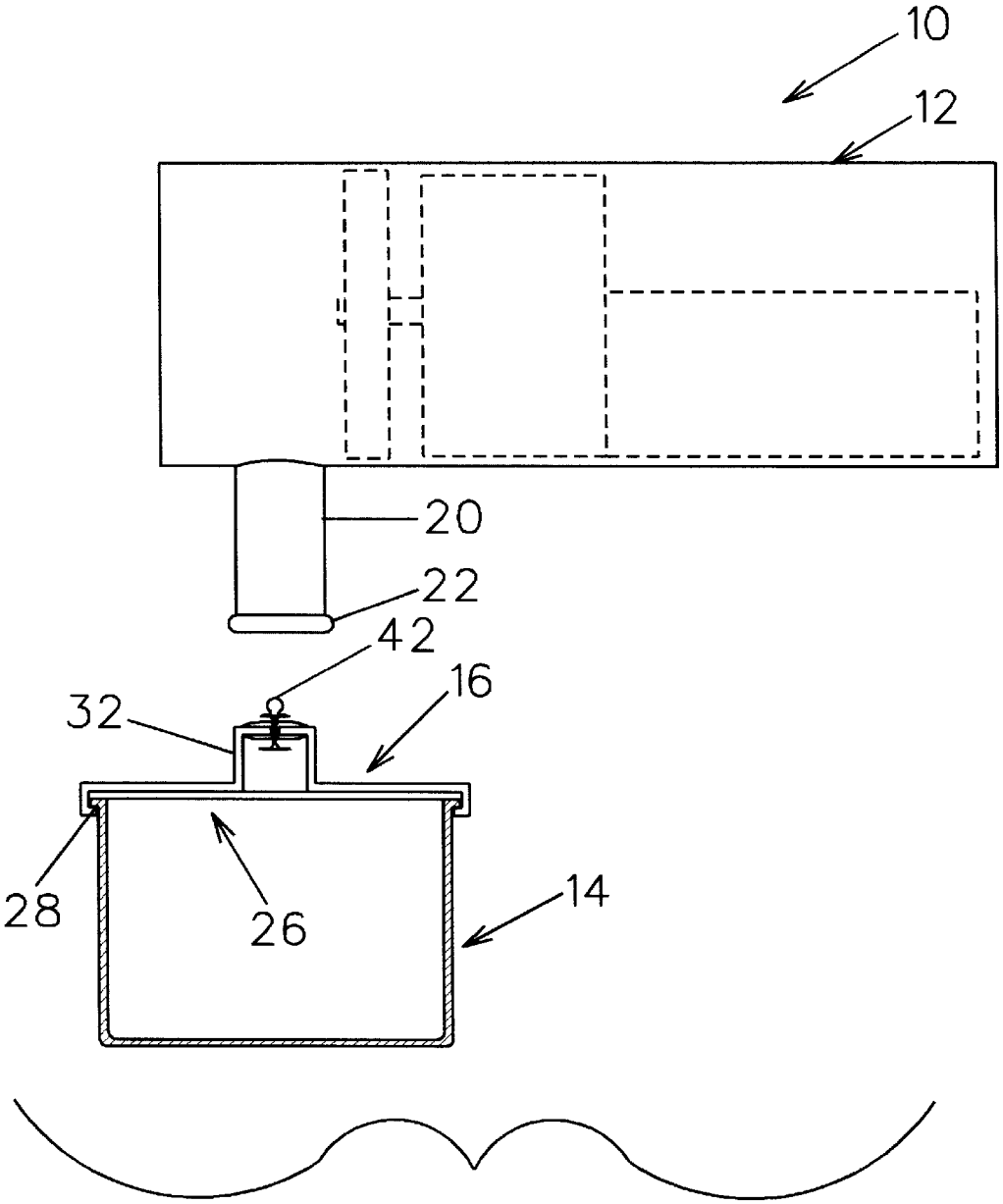
FIG. 1 is an exploded view of the vacuum storage system in accordance with the present invention, showing the storage chamber in section.
Figure 2:
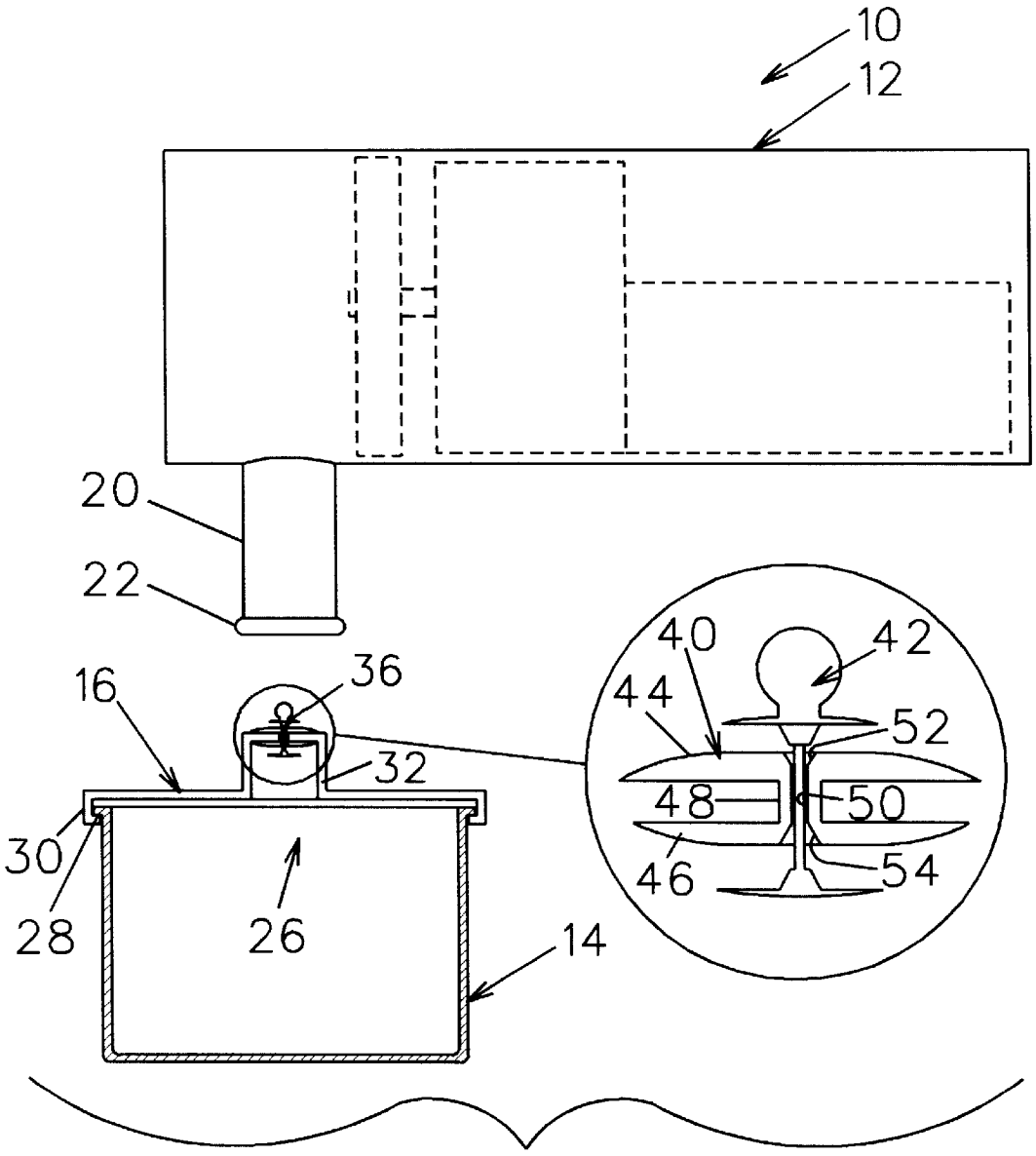
FIG. 2 is similar to FIG. 1 but shows the stopper and plug of the chamber lid enlarged for clarity.
Figure 3:
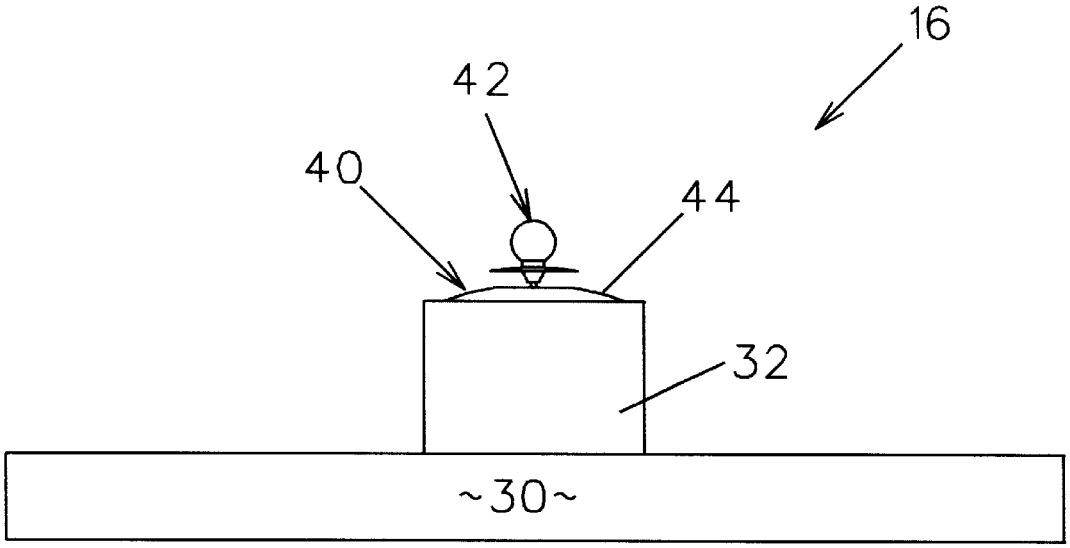
FIG. 3 is a side elevation view of the chamber lid.
Figure 4:
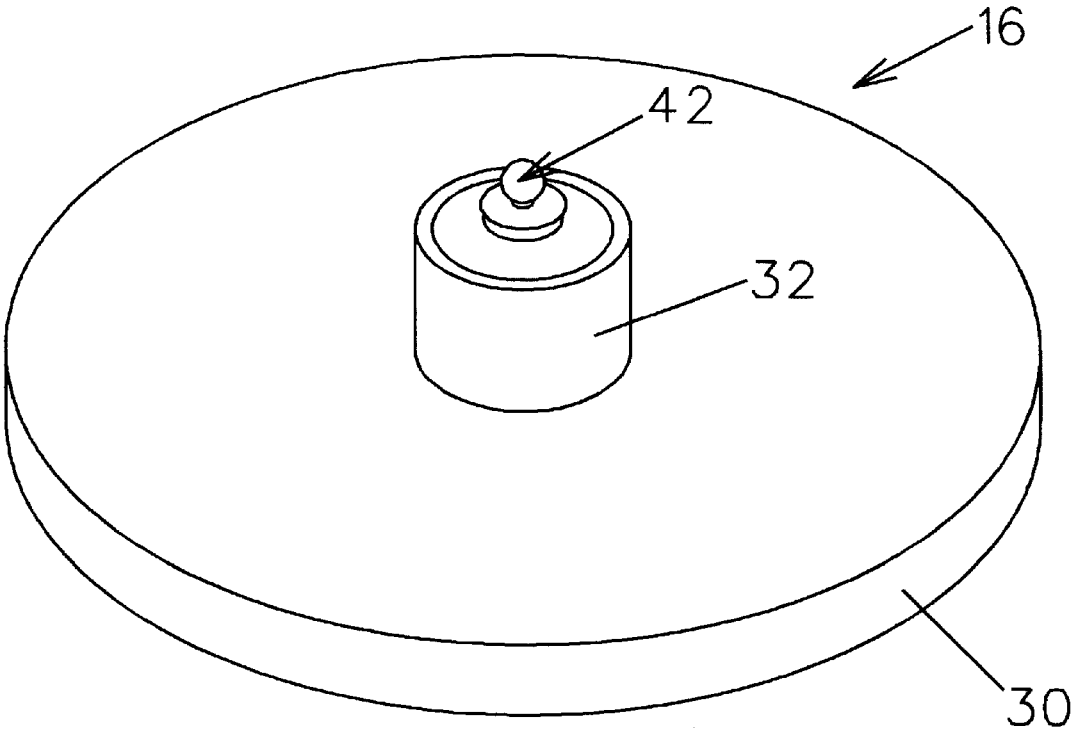
FIG. 4 is a perspective view of the chamber lid.
Figure 5:
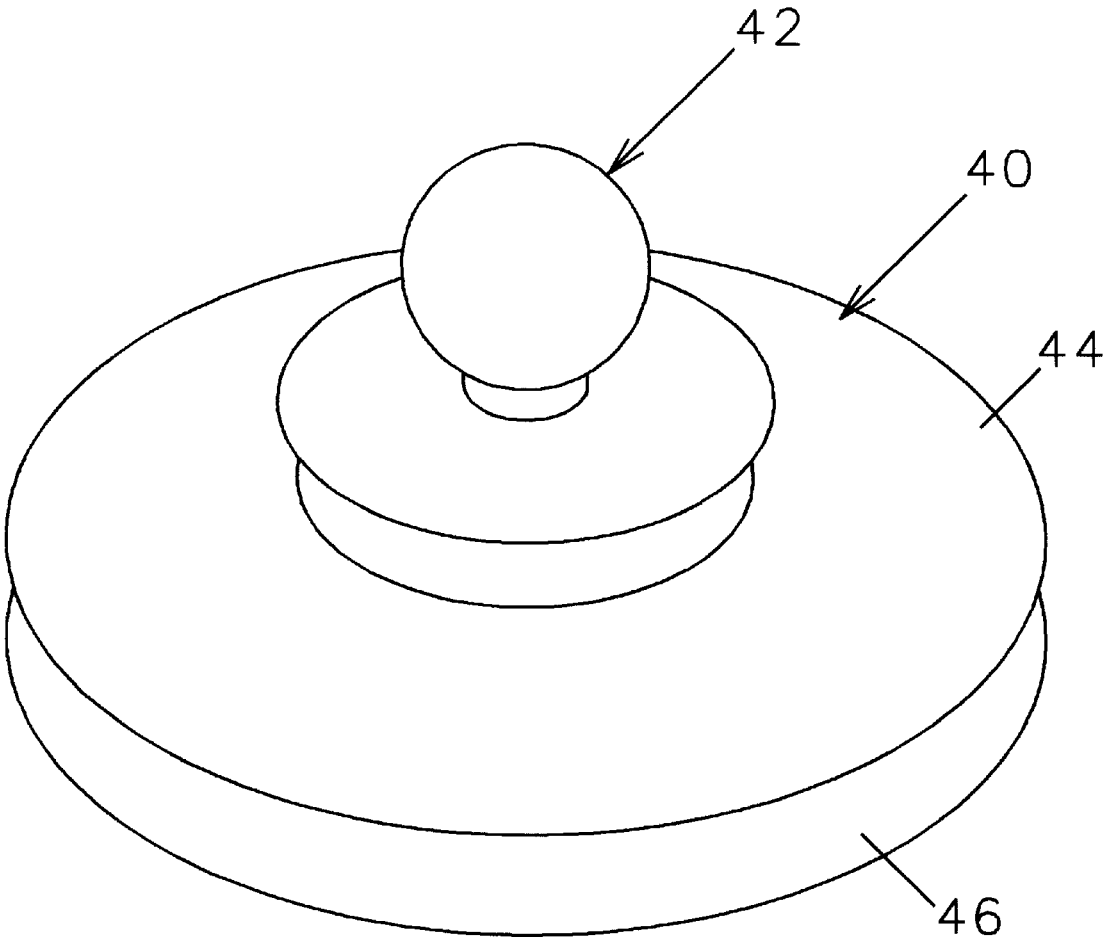
FIG. 5 is a perspective view of the stopper and plug combination of the chamber lid.

The vacuum storage system 10, as in FIGS. 1 and 2, includes vacuum unit 12, storage container or chamber 14 and lid 16. The storage system 10 improves the storage or shelf life of the goods stored within storage container 14 and prevents unwanted or dangerous fumes from escaping. Storage system 10 is simple and easy to use and can store household goods such as various food and paint products.

Vacuum unit 12 includes nozzle 20 and seal ring 22. Nozzle 20 extends outwardly from vacuum unit 12 and has seal ring 22 mounted on the free end thereof. Nozzle 20 attaches over lid 16 to evacuate air from within storage container 14.

Container 14 stores goods therein, such as food or paint products. Container 14 includes open end 26 and rim 28 which extends outwardly around the perimeter of container 14 at the open end 26. Container 14 can be any size or shape.

Lid 16 covers and seals open end 26 of container 14. Lid 16 is releasably securable to container and includes flange 30 which extends downwardly and inwardly around the perimeter of lid 16 over rim 28 of container 14 to thereby seal container 14.

Lid 16 includes a neck portion 32 that extends outwardly and upwardly from the center of lid 16. Neck 32 preferably has a diameter that is equal to or slightly smaller in diameter than vacuum unit's nozzle 20 for receipt therein. Thus, neck portion 32 facilitates attachment of vacuum unit 12 to lid 16.

Neck 32 includes opening 36 extending through the end of neck 32, preferably in the center thereof. Rubber stopper 40 and plug 42 are mounted within opening 36 and in combination, present a valve member.

Figure 6:
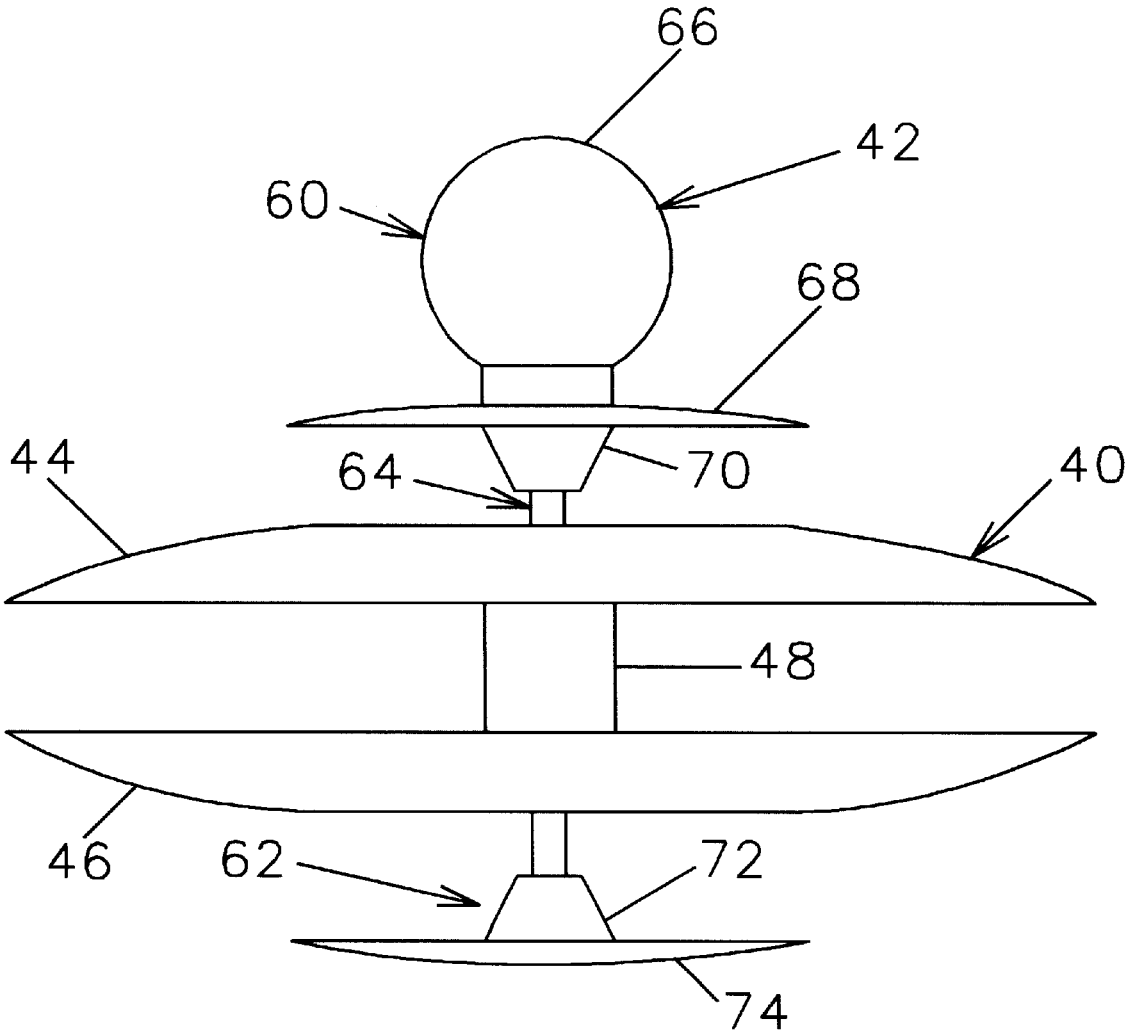
FIG. 6 is a side elevation view of the stopper and plug combination of FIG. 5.

Rubber stopper 40 provides an air-tight seal around opening 36. Rubber stopper 40, as best seen in FIG. 6, includes exterior and interior outwardly flaring portions 44 and 46, which are unitarily and integrally connected by arm 48. As seen in FIG. 2, exterior flaring portion 44 is adapted to engage the outer surface of neck 32, arm 48 extends through opening 36 and interior flaring portion 46 is adapted to engage the inner surface of neck 32, each in a sealing relationship to provide an air tight seal around opening 36.

Rubber stopper 40 further includes a channel 50 (FIG. 2) which extends through the center of exterior flaring portion 44, arm 48 and interior flaring portion 46. Channel 50 presents a diameter and includes outwardly tapered seat portions 52 and 54 at each end thereof. Channel 50 is sized to let a specific volume of air or gases be evacuated at a selected rate from within the container 14. Plug 42 is integral with stopper 40 and extends through channel 50 and is movable therewithin. Plug 42 includes exterior end 60, interior end 62 and stem 64. Exterior end 60 includes bulbous portion 66, flared portion 68 and tapered portion 70. Interior end 62 includes tapered portion 72 and flared portion 74. Stem 64 has a diameter smaller than the channel's diameter and therefore allows air to be evacuated from within container 14.

In operation, food or other goods are placed in container 14 for storage. Lid 16 is sealably secured over the open end 26 of container 14 by snapping flange 30 over rim 28.

Vacuum unit 12 is sealably connected over the neck 32 of lid 16. More specifically, nozzle 20 of vacuum 12 is placed over neck 32 with rubber seal ring 22 providing the necessary seal between nozzle 20 and neck 22.

Activation of vacuum 12 causes the air within the container 14 to be evacuated therefrom. The air is evacuated through channel 50 of rubber stopper 40, with stopper 40 providing a seal around opening 36. Because the diameter of the plug's stem 64 is smaller than the channel's diameter, air is allowed to flow outwardly through channel 50.

If vacuum is too strong tapered portion 72 will engage and mate with the interior seat portion 54 of channel 50. Additionally, the plug's interior flared portion 74 will engage the stopper's interior flared portion 46 and thereby seal channel 50 to preclude further evacuation. This action also precludes separation of plug from lid 16. Additionally, plug 42 acts similarly to prevent collapse of container 14.

Under normal evacuation circumstances, upon evacuation of the air from within container 14, a vacuum results within container 14 which causes the plug's exterior tapered portion 70 to mate and engage the stopper's exterior seat portion 52 of channel 50. Also, the plug's exterior flared portion 68 engages the stopper's exterior flaring portion 44 to thereby seal channel 50. Upon removal of vacuum unit 12, the goods stored within container 14 are vacuum packed. The goods will not spoil and odors and fumes will not escape from the container 14. The vacuum seal is released by pulling or tugging on the bulbous portion 66 of plug.

It is to be understood that while a certain form of this invention has been illustrated and described, it is not limited thereto except insofar as such limitations are included in the following claims and allowable functional equivalents thereof.

Having thus described the invention, what is claimed as new and desired to be secured by Letters Patent is as follows:

1. A vacuum storage system, comprising:

a chamber having an open end;

a lid releasably securable to said chamber over said open end, said lid having a neck portion with an aperture therethrough and including a stopper sealably mounted around said aperture and a plug mounted within said stopper; and a vacuum adapted for positioning over said neck portion to evacuate air from within said chamber;

said stopper having a channel therethrough, which presents a diameter;

said plug having a flared exterior end and an elongated portion, said elongated portion extending through said channel and having a diameter smaller than said channel's diameter for full movement therein to allow said vacuum to evacuate air from within said chamber through said channel;

said flared exterior end of said plug being adapted to engage and seal said channel upon evacuation of the air from within said chamber.

2. A vacuum storage container, comprising:

a chamber lid having an open end;

a lid releasabley securable to said chamber over said open end, said lid having an aperture therethrough and including a valve means for regulating the evacuation of air within said chamber;

said valve means including a stopper and a plug;

said stopper sealably mounted around said aperture and having a channel therethrough, said channel presenting a diameter, a length and first and second open ends;

said plug having a flared exterior end at one end of an elongated portion and a flared interior end at an opposite end of said elongated portion, said elongated portion extending through said channel and having a length longer than said channel's length of said channel and a diameter smaller than said channel's diameter for free movement therein to allow air to be evacuated from within said chamber through said channel;

said flared exterior end of said plug being urged in a first direction to seal said first end of said channel upon evacuation of air from within said chamber.

3. A vacuum storage container as claimed in claim 2 wherein said flared interior end is adapted to seal said second end of said channel upon movement of said flared interior end in a second direction opposite said first direction.

4. A vacuum storage container as claimed in claim 3 wherein said flared exterior end has a seat thereon said seat adapted to close said first end of said channel.

5. A vacuum storage container as claimed in claim 2 wherein said flared interior end has a seat thereon said seat adapted to close said second end of said channel.

* * * * *